US007117702B2

(12) United States Patent
Nyssen

(10) Patent No.: US 7,117,702 B2
(45) Date of Patent: Oct. 10, 2006

(54) MOBILE PIPE MILL

(76) Inventor: James Nyssen, 46544 Seaholm Crescent, Chilliwack, BC (CA) V2P 6K8

( * ) Notice: Subject to any disclaimer, the term of this patent is extended or adjusted under 35 U.S.C. 154(b) by 0 days.

(21) Appl. No.: 11/036,475

(22) Filed: Jan. 14, 2005

(65) Prior Publication Data

US 2006/0156775 A1 Jul. 20, 2006

(51) Int. Cl.
*B21C 37/12* (2006.01)

(52) U.S. Cl. ..... 72/49; 228/145

(58) Field of Classification Search ..... 72/48, 72/49, 50; 29/33 D; 228/145
See application file for complete search history.

(56) References Cited

U.S. PATENT DOCUMENTS 2,136,943 A * 11/1938 Freeze ..... 72/45
3,132,616 A * 5/1964 Hale et al. ..... 72/148
4,416,131 A * 11/1983 Davis ..... 72/11.5
4,660,399 A * 4/1987 Suter et al. ..... 72/181

* cited by examiner

*Primary Examiner*—Lowell A. Larson
(74) *Attorney, Agent, or Firm*—Barnes & Thornburg LLP

(57) ABSTRACT

A portable apparatus for forming pipe from helical convulsions of elongated sheet metal. A decoiler, rolling portion and pivot are mounted on a trailer, with a rigid frame extending from pivot and being laterally pivotable at the pivot in relation to the trailer. A forming head, cutoff saw, and dump table are mounted on the frame and pivotable therewith so that various diameters of pipe can be formed.

17 Claims, 8 Drawing Sheets

MOBILE PIPE MILL

BACKGROUND OF THE INVENTION

This invention relates to pipe forming apparatus, and in particular to a portable apparatus for forming pipe from helical convolutions of elongated sheet metal.

Apparatus for forming pipe from helical convolutions of sheet metal is well known. For example, U.S. Pat. No. 3,247,692 discloses a pipe making apparatus of the nature of that of the present invention, where the apparatus is installed in a factory or similar location, and different diameters of pipe are formed by moving the corrugating apparatus and coil reel in relation to a forming head, which is fixed in place. Pipe is then severed into discreet sections by a cutoff saw, not illustrated in the patent, formed in line with the forming head.

The inventor of the present application has also developed similar apparatus and ancillary equipment, as shown in, for example, U.S. Pat. Nos. 4,030,330; 4,070,886; 4,160,312; 4,161,811 and 4,220,181. All such apparatus is normally formed to be installed place in a factory or the like, and not be transported from one worksite to another.

The assignee of the present application has previously developed a portable type of machine constructed on two custom trailers. That structure, however, while being portable, is quite expensive and has found little acceptance in the marketplace.

U.S. Pat. No. 6,000,262 discloses another form of portable pipe making apparatus when mounted on a single trailer. While being fairly crude, it does demonstrate the concept of a simpler, portable pipe mill, although it has found no acceptance in the marketplace.

SUMMARY OF THE INVENTION

The invention is directed to a portable apparatus for forming pipe from helical convolutions of elongated sheet metal. It comprises, in sequential order, a decoiler which provides a source of the sheet metal, a rolling portion for advancing the sheet metal and forming any desired impressions in the sheet metal, a forming head for curling the sheet metal into adjacent helical convolutions and joining the convolutions to form a unitary pipe, a cutoff saw for severing the unitary pipe into discreet pipe sections, and a dump table for handling severed pipe sections. The forming head, cutoff saw and dump table are mounted on a rigid frame, with the frame being pivotable relative to the rolling portion to alter the diameter of the helical convolutions.

In accordance with the preferred form of the invention, the apparatus of the invention is located on a portable trailer, with the frame being laterally pivotable relative to the trailer. A controller is provided for the apparatus, and is connected to the dump table. The dump table has a plurality of deployable supports, and the controller is connected to the supports for leveling the dump table.

The decoiler includes a coil support, so that sheet metal may be unwound from a coil for feeding to the rolling portion. The rolling portion comprises a plurality of forming stands for successively forming corrugations or the like in the metal sheet.

In accordance with the preferred form of the invention, the forming head includes three rolls, each of the rolls comprising a series of interconnected pivotal rollers. The apparatus preferably forms a lock seam to join adjacent pipe convolutions, and the forming head includes seaming apparatus for joining those convolutions.

As is typical in pipe mills of the nature of the invention, the cutoff saw is a traveling cutoff saw that travels with the emerging pipe as it is manufactured until it is severed. The severed pipe extends on the dump table, and a spin lift is located between the cutoff saw and the dump table to advance the pipe onto the dump table for later handling and avoiding of interference with oncoming pipe as it is manufactured.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
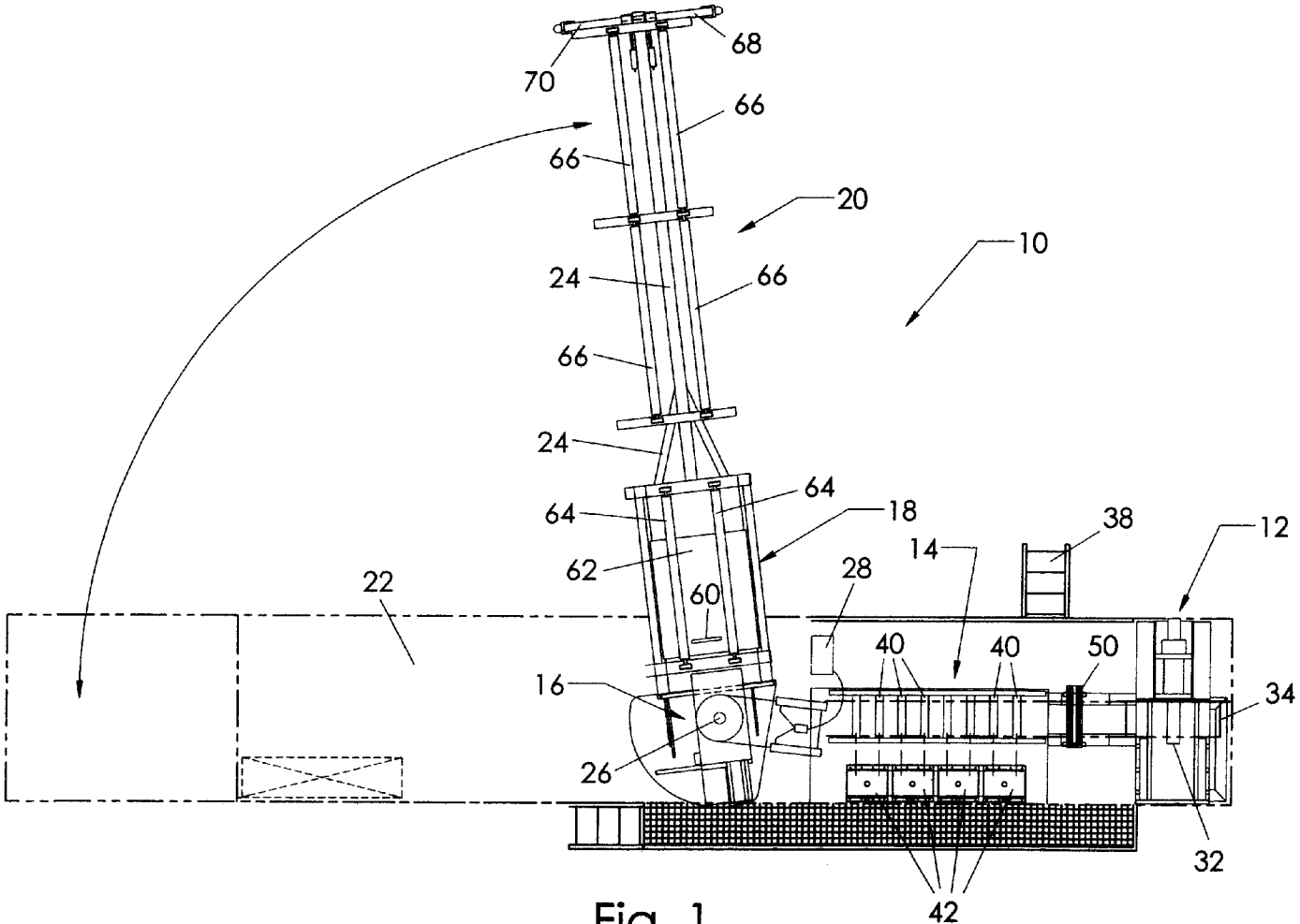
FIG. 1 is a top plan view of the apparatus according to the invention, with the cutoff saw and dump table being deployed laterally from the trailer upon which the apparatus is located.

The invention is shown generally at 10 in the drawing figures. As primary components, it includes a decoiler 12, rolling portion 14, forming head 16, cutoff saw 18 and dump table 20, all mounted on a trailer 22 which, as is conventional, may be pulled by a suitable truck tractor (not illustrated) in a conventional fashion.

Figure 2:
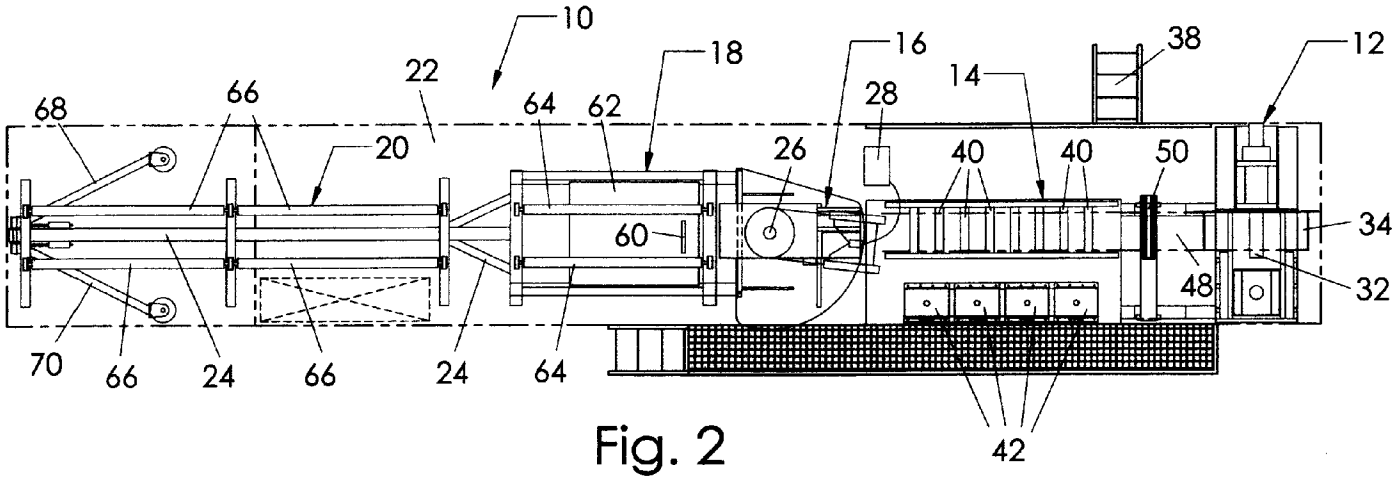
FIG. 2 is a top plan view similar to FIG. 1, but with the cutoff saw and dump table being stowed on the trailer.
Figure 3:
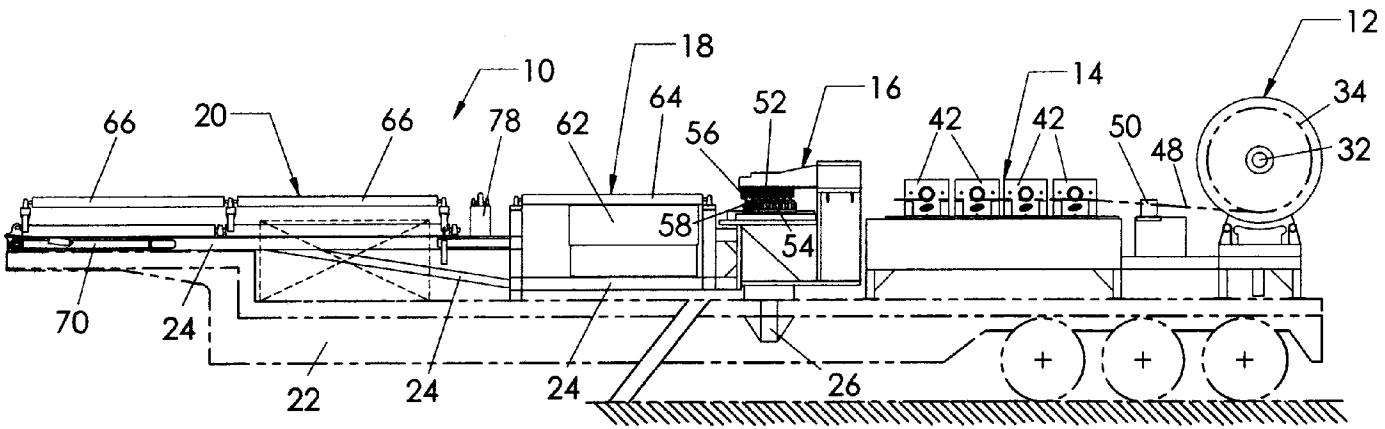
FIG. 3 is a side elevational view of the apparatus illustrated in FIG. 2.
Figure 4:
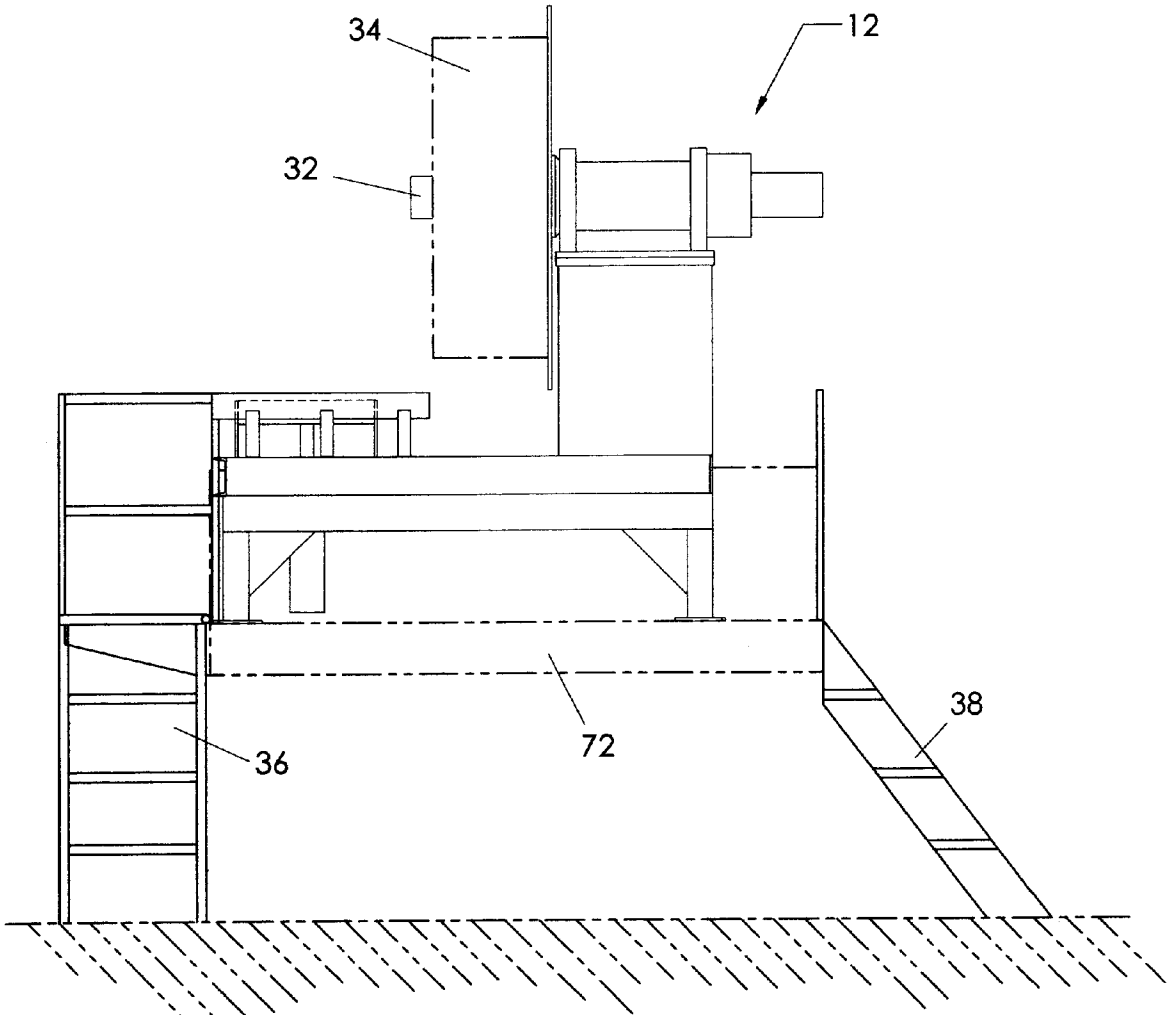
FIG. 4 is an enlarged end illustration, taken from the right end of FIGS. 1 through 3, showing the decoiler as mounted on the trailer.

The forming head 16, cutoff saw 18 and dump table 20 are mounted on a rigid frame 24, the frame 24 being pivotable relative to the trailer 22 and the rolling portion 14 by means of a pivot 26. As best shown in FIGS. 1 through 3, the frame 24, and its mounted elements, can be rotated from a stowed position on the trailer 22 to any deployed position up to practically a 90° angle, as shown in FIG. 1. As is well known in the art, and as explained in U.S. Pat. No. 3,247,692, the disclosure of which is incorporated herein by reference, by selecting the angle of deployment, there is established an angular relationship between the forming head 16 and the upstream rolling portion 14. Depending on the angle, pipe of varying diameters is manufactured by the apparatus 10.

For control of all elements of the invention, a controller 28 is employed. The controller 28 preferable is a typical PLC which can be programmed to perform the various functions described, being connected to motors or server motors, as appropriate, as will be evident from the following description and as is well known to those skilled in the art.

The decoiler 12 may be conventional, and thus includes a coil spindle 32 for mounting a coil 34 of elongated sheet metal. Typically no motor is required for the decoiler 12, all motive power for removing sheet metal from the coil 34 being provided by the rolling portion 14. In the vicinity of the decoiler 12, ladders 36 and 38 can be provided for easy access to the trailer 22.

Figure 5:
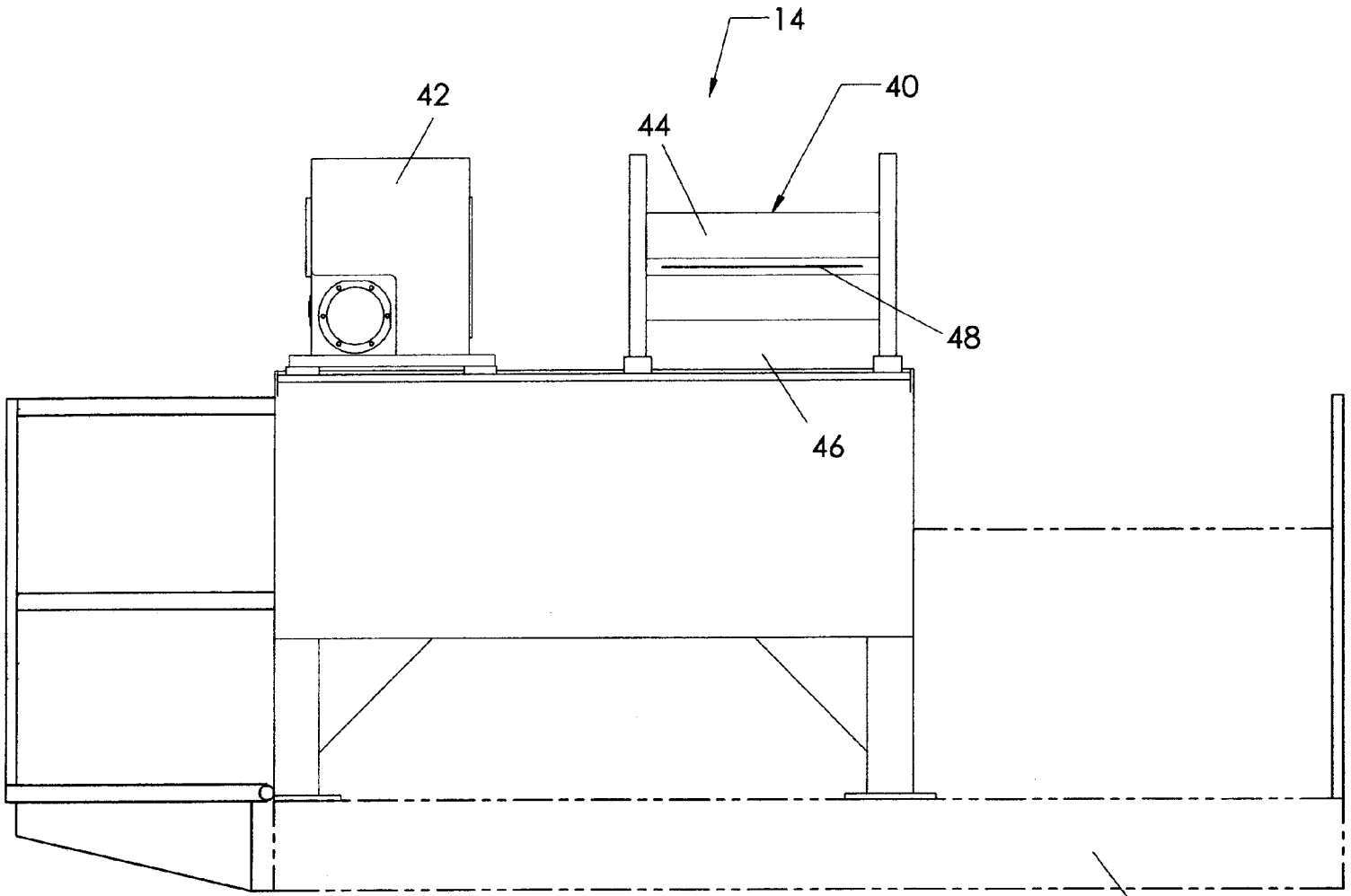
FIG. 5 is a downstream view, following the decoiler, schematically showing a typical stand of the rolling portion.
Figure 6:
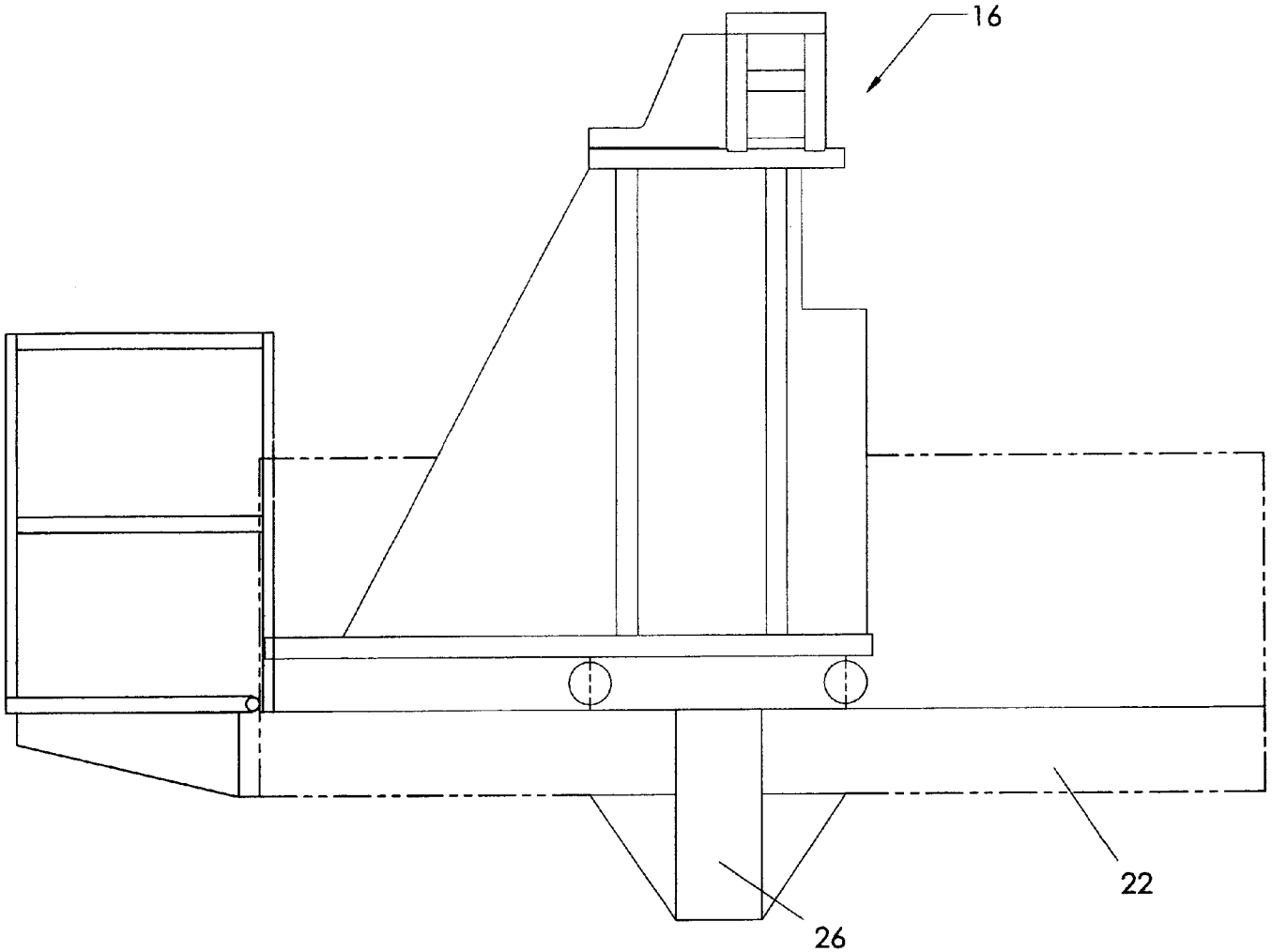
FIG. 6 is an enlarged illustration downstream from the rolling portion, showing the forming head in the stowed position.

The rolling portion 14 may also be conventional, and as is typical, is comprised of a series of forming stands for successively forming corrugations or other impressions in metal sheet emanating from the coil 34. Eight stands 40 are illustrated, with each pair of stands being driven by a motor 42 operated by the controller 28. As best illustrated in FIG. 5, each of the stands 40 is composed of a pair of rollers 44 and 46 between which the sheet 48 of elongated sheet metal issued from the coil 34 passes. As is conventional, the rollers 44 and 46 form impressions in the sheet 48, such as corrugations or the like, as the sheet 48 proceeds through the various stands 40.

The coil of sheet metal 34 holds only a finite length of sheet metal, and once exhausted, must be replaced with another. In order to join the sheets of an exhausted coil to a new coil, a welding table 50 is provided. Other means of joining the sheets can be provided, as well.

The forming head 16 preferably includes three forming rolls, each of which comprises a series of interconnected pivotal rollers, as disclosed in incorporated U.S. Pat. No. 3,247,692. This is conventional, and two of the series of rollers are illustrated at 52 and 54 in FIG. 3, the third series of rollers, in relation to FIG. 3, being located immediately behind the series of rollers 54 in a conventional fashion. The forming head 16 also includes seaming rollers 56 and 58 for completing a lock seam, thus joining adjacent convolutions of metal pipe emanating from the forming head 16 and passing downstream.

The cutoff saw 18 may also be conventional, and is what is known as a traveling or "flying" cutoff saw, in that the saw blade 60, which is mounted in a saw carriage 62, travels with emanating formed pipe as it issues from the forming head 16 in order to sever successive, pipe sections.

Pipe support rollers 64 are provided on opposite sides of the blade 60. As illustrated, the dump table 20 includes a series of support rollers 66 for supporting a pipe section while it is severed by the cutoff saw 18 and immediately thereafter. The dump table 20 is operated, as its name suggests, periodically to remove a severed pipe section therefrom. Dumping is controlled by the controller 28 and is in a conventional fashion, and is therefore not further described.

Figure 8:
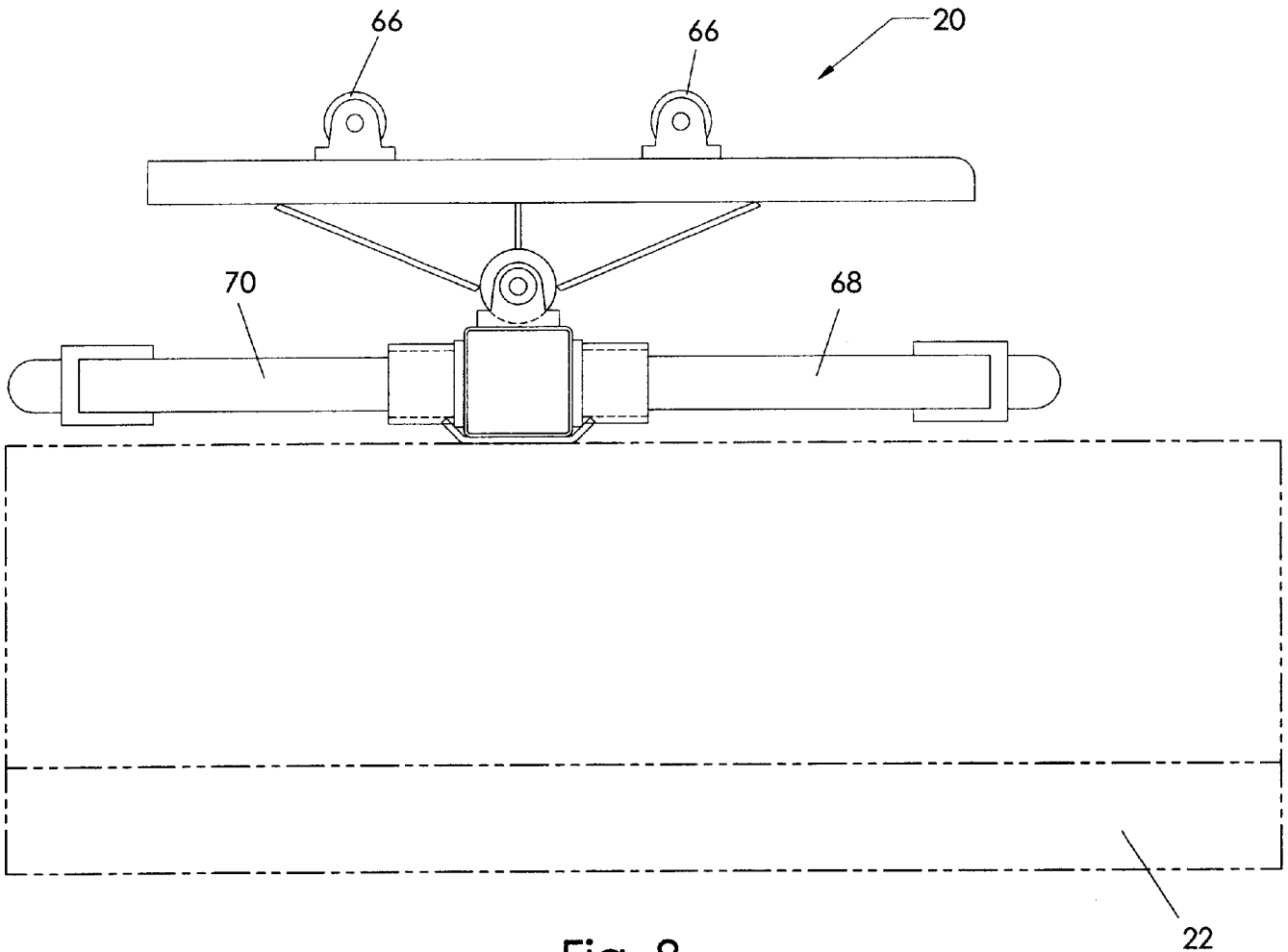
FIG. 8 is an enlarged illustration of the dump table when stowed on the trailer.
Figure 10:
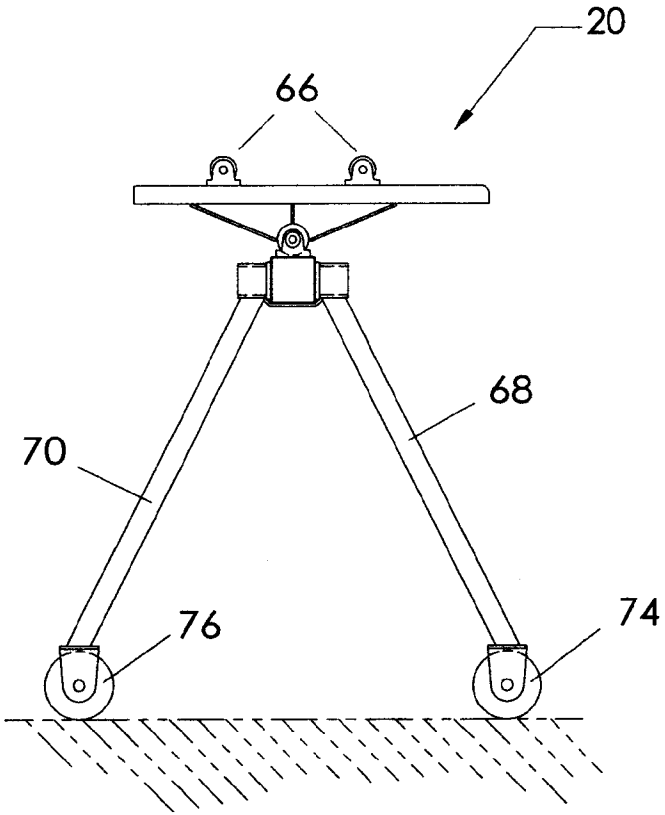
FIG. 10 is an end illustration, taken from the left end of FIG. 9, showing the deployed dump table.
Figure 9:
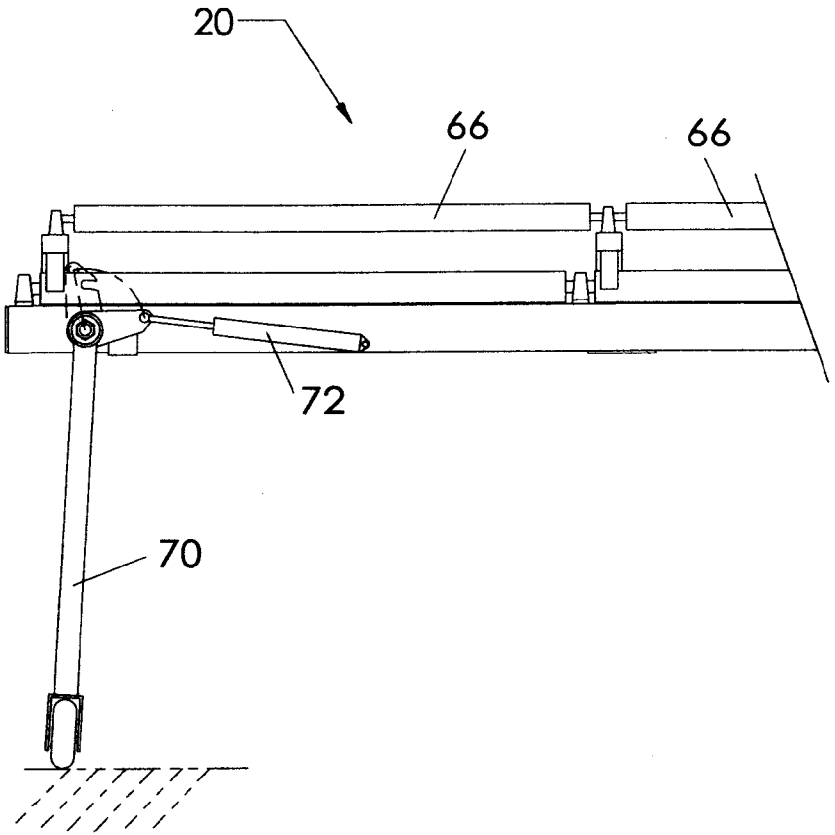
FIG. 9 is a partial side elevational view of the dump table when deployed.

The dump table 20 is part of the structure mounted on rigid frame 24 which, when the rigid frame is deployed from the trailer 22, must also be supported. To that end, support legs 68 and 70 and are provided. When the apparatus is stowed, the legs 68 and 70 are folded as shown in FIGS. 2, 3 and 8. However, when the apparatus is deployed for making pipe, the support legs 68 and 70 are extended, preferably by an appropriate cylinder 72 (one of which is shown in FIG. 9). The cylinder 72 is operated by the controller 28, and is preferably self-leveling by appropriate programming of the controller 28. As soon as the dump table 20 is deployed, the controller 28 extends the legs 68 and 70, and respective wheels 74 and 76 facilitate the movement of the dump table 20 as it is swung into place.

Figure 7:
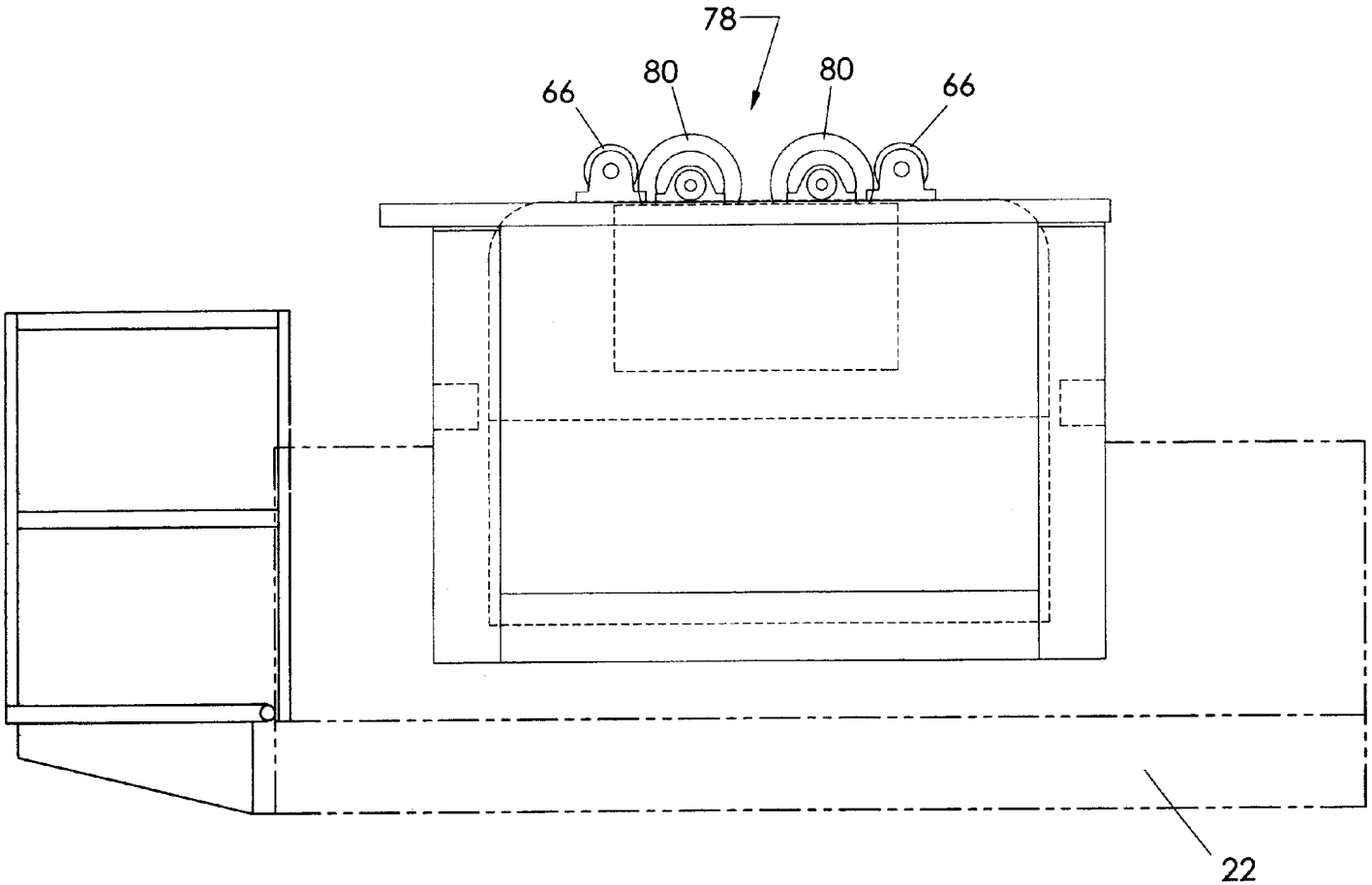
FIG. 7 is an enlarged view of the spin lift located between the cutoff saw and the dump table.

Once a pipe section is severed by the cutoff saw 18, it is preferred that the pipe section be advanced so as to not interfere with the next-succeeding pipe section as it emanates from the forming head 16. To that end, a spin lift 78 is located between the cutoff saw 18 and the dump table 20. The spin lift 78 is operated after a pipe section has been cut in order to move the pipe section further onto the dump table 20. As its name suggests, the spin lift 78 is lifted to engage the pipe section, and then spins the pipe section which then advances the pipe section onto the dump table 20. As illustrated in FIG. 7, the spin lift 78 employs a pair of rollers 80 for this purpose. Operation of the spin lift 78 is conventional, and is therefore not described in greater detail.

The apparatus 10 of the invention provides a uniquely portable type of mill which is readily deployed and, given the "stiff" pivot 26 with extending frame 24, comprises a rigid structure with the dump table 20 always in proper alignment with the forming head 16. Pipe diameters from the very small to the very large can be manufactured, depending on the extent of deployment of the frame 24 from the trailer 22, with diameters increasing as the angle of deployment increases. Various changes can be made to the invention without departing from the spirit thereof, or scope of the following claims.

What is claimed is:

1. A portable apparatus for forming pipe from helical convolutions of elongated sheet metal, comprising, in sequential order, a. a decoiler providing a source of the sheet metal, b. a rolling portion for advancing the sheet metal and forming any desired impressions in the sheet metal, c. a forming head for curling the sheet metal into adjacent helical convolutions and joining the convolutions to form a unitary pipe, d. a cutoff saw for severing the unitary pipe into discreet pipe sections, and e. a dump table for handling severed pipe sections, f. wherein the forming head, cutoff saw and dump table are mounted on a rigid frame, the frame being pivotable relative to the rolling portion to alter the diameter of the helical convolutions.

2. The apparatus according to claim 1 located on a portable trailer, said frame being laterally pivotable relative to said trailer.

3. The apparatus according to claim 1 including a controller connected to said dump table.

4. The apparatus according to claim 3 including a plurality of deployable supports for said dump table, said controller being connected to said supports for leveling said dump table.

5. The apparatus according to claim 1 including a plurality of deployable supports for said dump table.

6. The apparatus according to claim 1 in which said decoiler includes a coil support.

7. The apparatus according to claim 1 in which said rolling portion comprises a plurality of forming stands for successively forming corrugations in the metal sheet.

8. The apparatus according to claim 1 in which said forming head includes three forming rolls, each roll comprising a series of interconnected pivotal rollers.

9. The apparatus according to claim 8 including seaming apparatus in said forming head for joining the convolutions.

10. The apparatus according to claim 9 in which said seaming apparatus comprises a lock seam former.

11. The apparatus according to claim 1 in which said cutoff saw is a traveling cutoff saw.

12. The apparatus according to claim 1 including a spin lift located between said cutoff saw and said dump table.

13. A portable apparatus for forming pipe from helical convolutions of elongated sheet metal, comprising a. a trailer, b. a decoiler mounted on the trailer, c. a rolling portion mounted downstream of the decoiler, d. a pivot located on the trailer downstream of the rolling portion, e. a rigid frame extending from the pivot and being laterally pivotable at the pivot in relation to the trailer, f. a forming head mounted on said frame at said pivot, g. a cutoff saw mounted on said frame downstream of the forming head, and h. a dump table mounted on said frame downstream of the cutoff saw.

14. The portable apparatus according to claim 13 including a controller connected to said dump table.

15. The portable apparatus according to claim 14 including a plurality of deployable supports for said dump table, said controller being connected to said supports for leveling said dump table.

16. The portable apparatus according to claim 13 including a plurality of deployable supports for said dump table.

17. The portable apparatus according to claim 13 including a spin lift located between said cutoff saw and said dump table.

* * * * *